United States Patent [19]

Hirata et al.

[11] 4,251,956

[45] Feb. 24, 1981

[54] APPARATUS FOR DESCALING METAL STRIP

[75] Inventors: Hiromasa Hirata, Yokohama; Toyohiko Kirisawa, Mito; Takao Kawanami, Tokai; Michio Sato, Tokai; Yasuhiro Omura, Tokai, all of Japan

[73] Assignee: Ishikawajima-Harima Jukogyo Kabushiki Kaisha, Tokyo, Japan

[21] Appl. No.: 2,098

[22] Filed: Jan. 9, 1979

[30] Foreign Application Priority Data

Jan. 18, 1978 [JP] Japan ..... 53/3941

[51] Int. Cl.[3] ..... B24C 3/12

[52] U.S. Cl. ..... 51/428; 51/321; 134/15; 134/34; 134/122 R

[58] Field of Search ..... 134/7, 9, 15, 34, 64 R, 134/122 R, 172; 29/81 B; 239/566; 51/319, 320, 321, 410, 428

[56] References Cited

U.S. PATENT DOCUMENTS

| | | | |
|---|---|---|---|
| 3,510,065 | 5/1970 | Gigantino et al. | 29/81 B |
| 3,511,250 | 5/1970 | Gallucci et al. | 134/122 R |
| 3,543,775 | 12/1970 | Bodnar | 134/64 R |
| 3,775,180 | 11/1973 | Hirata et al. | 134/7 |
| 3,894,883 | 7/1975 | Franz | 134/15 |
| 3,983,889 | 10/1976 | Thym et al. | 134/15 X |

*Primary Examiner*—Marc L. Caroff

*Attorney, Agent, or Firm*—Scrivener, Clarke, Scrivener and Johnson

[57] ABSTRACT

A descaling slurry is applied to a surface of an elongated metal strip from a nozzle array while the strip is moving in the direction of its length. The nozzle array is positioned in spaced relation to the strip surface and extends transversely to the strip at an acute angle so that the individual slurry streams emanating from the nozzles do not intersect and strike the strip in a line at the same acute angle as the nozzle array. The nozzles of the array are directed toward the strip surface at an acute spray angle in the direction of movement of the strip.

6 Claims, 8 Drawing Figures

Fig. 1A
PRIOR ART
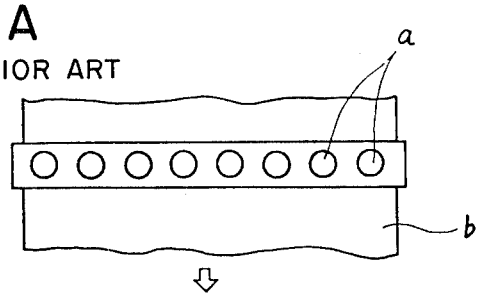
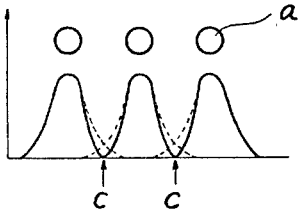
Fig. 1B PRIOR ART
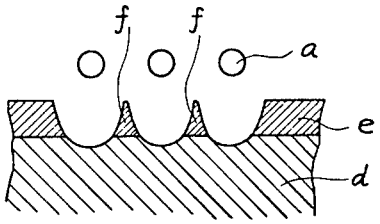
Fig. 1C PRIOR ART
Fig. 2A
PRIOR ART
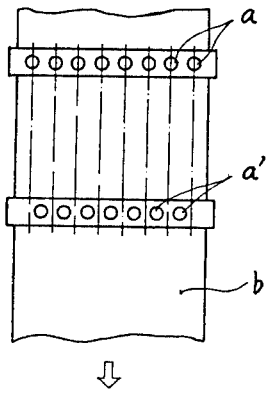
Fig. 2B
PRIOR ART
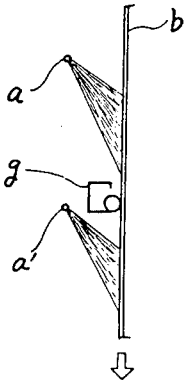

APPARATUS FOR DESCALING METAL STRIP

DETAILED DESCRIPTION OF THE INVENTION

The present invention relates to a method and apparatus for descaling strip or sheet in a continuous cold rolling mill where hot rolled strip or sheet is cold rolled.

Extensive studies and experiments have been continuously made in order to find out more effective and efficient descaling methods and equipment. In general, chemical descaling methods have been long used. That is, the hot rolled strip or sheet is made to pass through a pickling tank containing sulfuric acid or hydrochloric acid prior to being subjected to the cold rolling. However the chemical descaling methods take a long time and are low in efficiency. Therefore the recent trend is toward the mechanical descaling methods and equipment wherein the descaling slurry (consisting of a liquid and abrasives) is impinged against the strip or sheet so as to remove its scales.

According to one of the mechanical descaling methods, a single nozzle or an array of nozzles for ejecting and impinging the descaling slurry against the strip or sheet is disposed at right angles to the direction of the passage of the strip or sheet. With a single nozzle, an area to be descaled is very small so that it cannot be used in practice.

Therefore in general a plurality of nozzles have been disposed in a row. (This arrangement will be referred to as "the nozzle block or assembly" in this specification.) When the nozzle block or assembly consisting of a plurality of nozzles a is disposed at right angles to the direction of the passage of strip or sheet b as shown in FIG. 1(A), the descaling slurry sprayed from the respective nozzle a is impinged against the strip or sheet b with the pressure distribution as indicated by the broken lines in FIG. 1(B), but in practice because of the interference between the adjacent nozzles a, the descaling slurry is impinged against the strip or sheet b with the pressure distribution as indicated by the solid lines. As a result, at c where the descaling slurries ejected out of the adjacent nozzles a interfere with each other, the strip or sheet b is subjected to less descaling effects so that even when descaling slurry is sprayed under such a high pressure that even the base d of the strip or sheet b is eroded to some extent as shown in FIG. 1(C), some scales still remain as indicated at f. Experiences showed that even when the distance between the adjacent nozzles a is shortened, scales f still remain at the portions where the interference of descaling slurries has occured. Thus with this method the uniform descaling of the strip or sheet cannot be attained.

In order to overcome the above problem, there has been devised and demonstrated a method in which, as shown in FIG. 2, two nozzle blocks or assemblies are disposed and spaced apart vertically by a suitable distance in such a way that the nozzle orifices a and a' of the upstream and downstream nozzle blocks or assemblies may be staggered. With this arrangement, the scales f still remaining after the strip or sheet having passed past the upstream nozzle block or assembly are removed by the descaling slurries ejected out of the nozzles a of the downstream block or assembly. However, in practice, the interference between the descaling slurries ejected out of the upstream and downstream nozzle blocks or assemblies does occur so that the descaling power or capability of the downstream nozzle block or assembly a' is considerably downgraded. In order to overcome this problem, there has been proposed to dispose a descaling slurry collecting device g between the upstream and downstream nozzle blocks or assemblies a and a' in order to collect the descaling slurries sprayed from the upstream nozzle block or assembly and flowing downwards over the surface of the strip or sheet b. The collecting device g is subjected to rapid wear by errosion so that it must be replaced at a frequent interval. As a result, the descaling line must be stopped or shut down frequently so that the over-all productivity is considerably decreased. Furthermore, because of the installation of the collecting device g between the upstream and downstream nozzle blocks or assemblies, the latter must be spaced apart from each other so that the increase in length of the descaling equipment and hence the descaling line results.

Moreover this method has another serious problem. This is, as described above, the nozzle orifices a of the upstream nozzle block may be staggered relative to those of the downstream nozzle block or assembly, but in practice the strip or sheet b moves in a zig-zag direction or weaves so that it does not follow that the remaining scales f pass just below the nozzle orifices of the downstream nozzle block or assembly a'. Thus the uniform descaling cannot be ensured.

The present invention was made to overcome the above and other problems encountered in the prior art mechanical descaling methods and equipment, and will become apparent from the following description of one preferred embodiment thereof taken in conjunction with the accompanying drawings, in which:

FIGS. 1(A), 1(B), 1(C) and FIGS. 2(A) and 2(B) are views used for the explanation of the problems encountered in the prior art methods and equipment;

FIGS. 3(A), 3(B) and 3(C) are views used for the explanation of the underlying principle of the present invention;

First referring to FIGS. 3(A), 3(B), 3(C) and 4, the underlying principle of the present invention will be described. A plurality of nozzles 2 are spaced apart from each other by such a distance that the interference between the descaling slurries ejected out of the adjacent nozzles may not occur. The nozzles 2 are disposed relative to the strip or sheet 1 traveling in the direction indicated by the arrow shown in FIG. 3(A) in such a way that the line l' connecting the centers of the nozzle orifices may be inclined at an angle $\alpha$ relative to the direction of the passage of the strip or sheet 1 when viewed from the above. Therefore the angle between the axis of each nozzle 2 and the direction of passage of the strip or sheet 1 is $(90°-\alpha)$. This angle will be referred to as "the spray direction angle" in this specification.

Figure 3A:
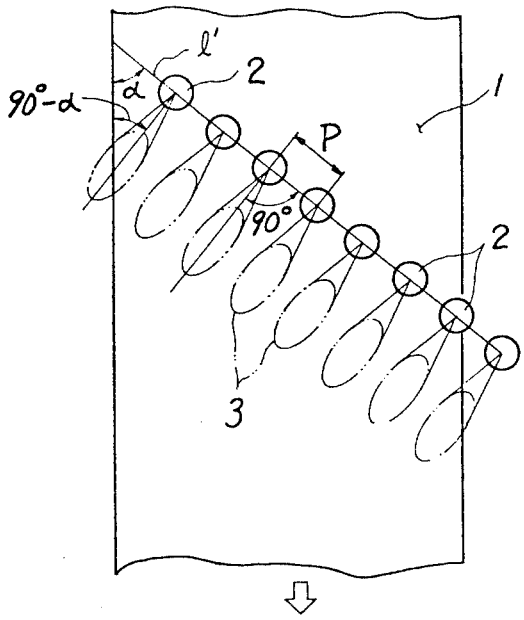
Figure 3B:
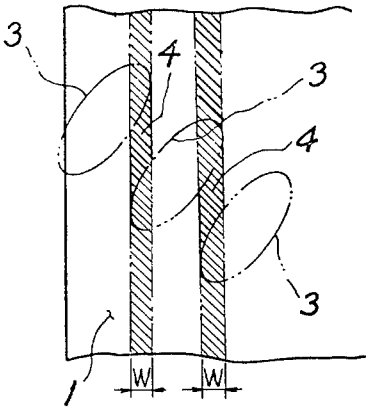
Figure 3C:
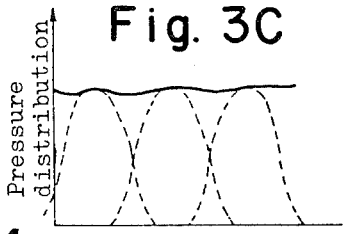

Each nozzle 2 sprays the descaling slurry over an area 3 on the surface of the strip or sheet 1 as shown in FIG. 3(B), the area 3 being referred to as "the sprayed area" in this specification. It is to be emphasized that the adjacent nozzles 2 are so spaced apart from each other that a part of the upstream sprayed area 3 may overlap a part of the downstream sprayed area 3, thus leaving the overlapped area 4 with a width w as shown in FIG. 3(B). If the descaling slurry is sprayed from one nozzle 2, it is impinged against the strip or sheet 1 with the pressure distribution as indicated by the broken line curves (concave upward) in FIG. 3(C), but when it is sprayed simultaneously from all nozzles 2, its pressure is uniformly distributed as indicated by the solid line curve because the adjacent pressure curves are positively coupled. Thus the strip or sheet 1 may be uniformly descaled. In summary, according to the present invention, descaling is started from one edge of the strip or sheet 1 and proceeded or progressed successively toward the other edge. As a result, the energy imparted to the strip or sheet 1 from the descaling slurry ejected from an upstream nozzle 2 also facilitates the separation and removal of scales at the area 3 sprayed with the descaling slurry ejected from a next downstream nozzle 2. Thus the cooperative descaling effects can be obtained.

Figure 4:
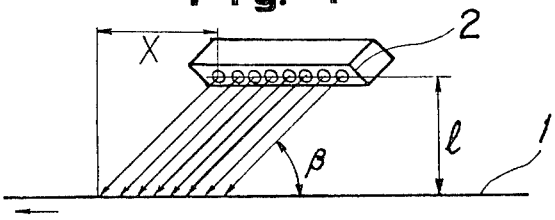
FIG. 4 is a view used for the angular position of a nozzle block or assembly in accord with the present invention.
Figure 5:
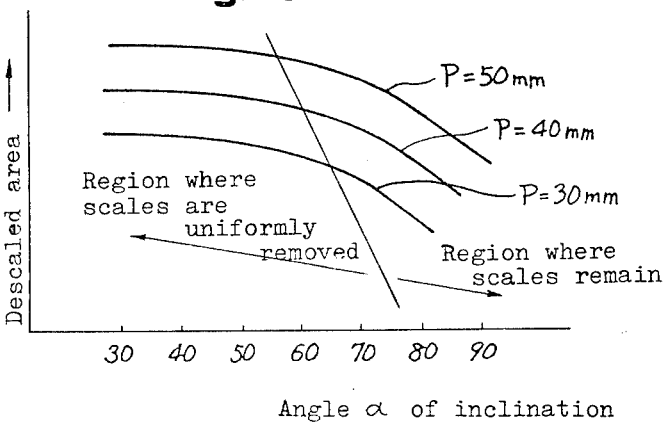
FIG. 5 is a graph showing the relationship between the angle of the axis of the nozzle with respect to the surface of the strip or sheet to be descaled and the area descaled.

Next referring to FIG. 4, the nozzles 2 are disposed with the spray angle $\beta$; that is the angle between the axis of the nozzle 2 and the strip or sheet 1. The distance l between the nozzle orifice and the strip or sheet 1 is selected depending upon the conditions of scales on the strip or sheet 1 and the rate of descaling slurry sprayed from the nozzle 2. It is to be emphasized that the angle $\alpha$ of inclination [See FIG. 3(A)] must be changed without causing the changes in the spray angle $\beta$ and the spray distance l. The distance P between the nozzles 2, which is partly dependent upon the type of the nozzles 2, is mainly determined from the experiments. For instance, from the experiments the graph as shown in FIG. 5 is obtained and the distance P is selected so that uniform descaling may be ensured.

Figure 6:
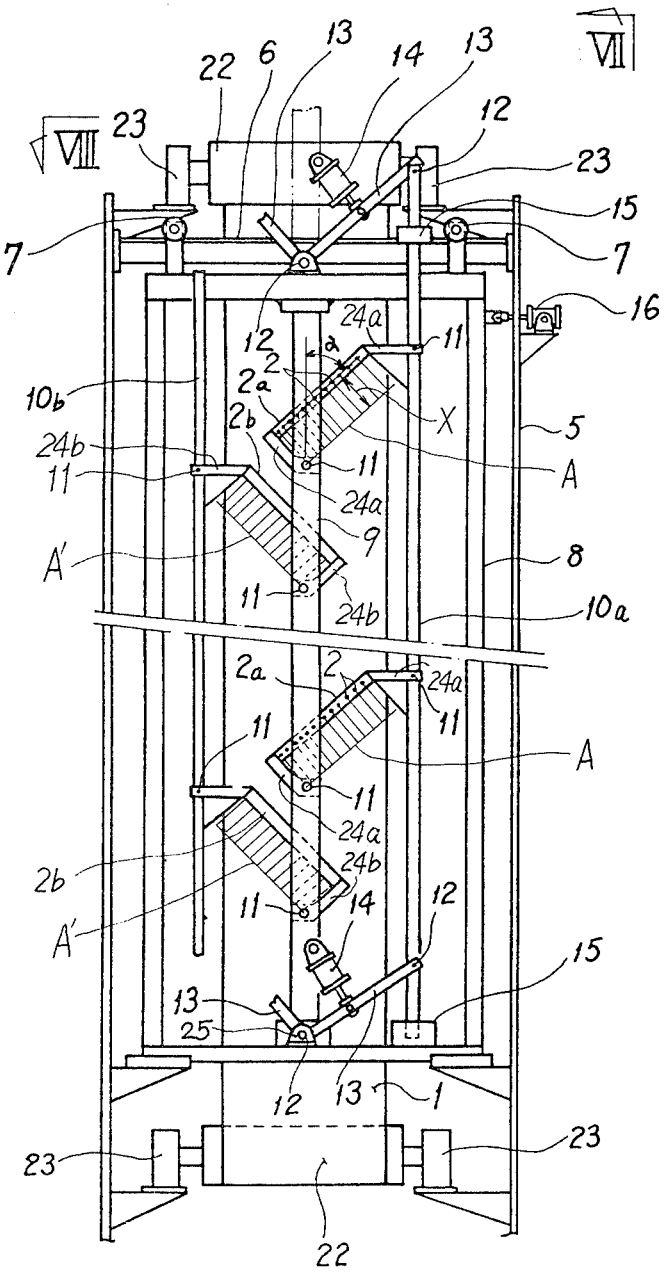
FIG. 6 is a schematic side view of an embodiment of a descaling apparatus in accord with the present invention.
Figure 7:
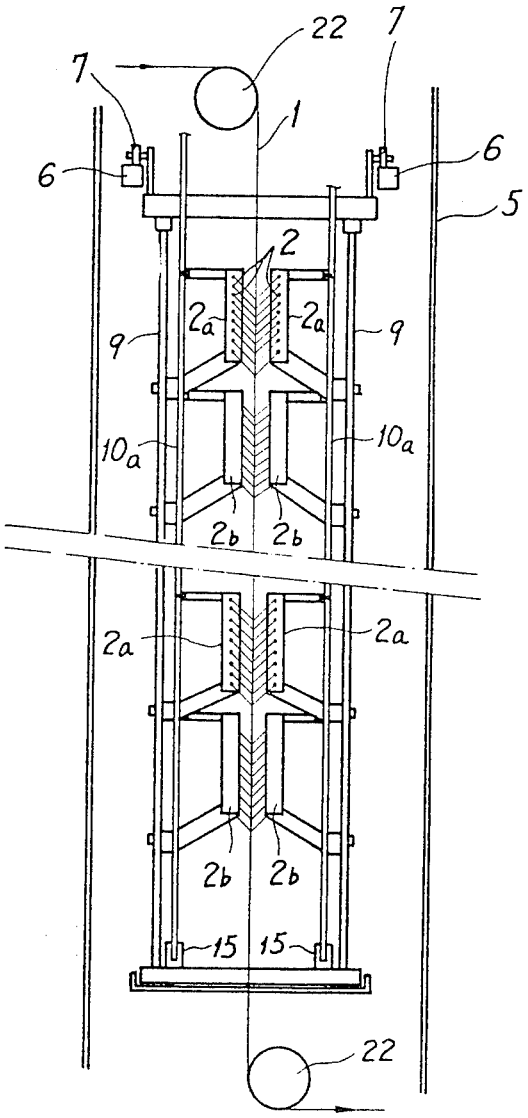
FIG. 7 is a view looking in the direction indicated by the arrow VII of FIG. 6.
Figure 8:
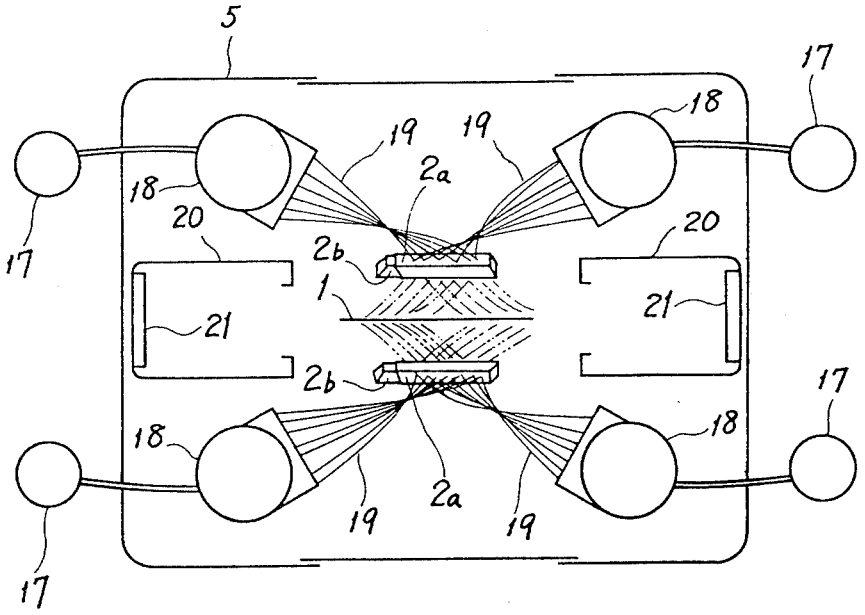
FIG. 8 is a top view, on enlarged scale, thereof looking in the direction indicated by the arrow VIII of FIG. 6.

Referring next to FIGS. 6–8, a descaling equipment embodying the underlying principle of the present invention described hereinbefore will be described. As best shown in FIG. 7, the strip or sheet 1 is guided by upper and lower rolls 22 supported by bearings 23 (See FIG. 6) so as to pass the descaling equipment vertically downwardly. The descaling equipment comprises in general a main body or frame 5 and a movable frame or nozzle carriage 8. The movable frame 8 is in the form of a cage rectangular both in vertical and horizontal sections. It has two parallel nozzle supporting columns 9 which are horizontally spaced apart from each other by a suitable distance as best shown in FIG. 7 and have their upper and lower ends securely fixed to the top and bottom tie beams of the movable frame 8 intermediate their ends. The movable frame or nozzle carriage 8 is suspended from wheels 7 running on the rails 6 extended at the top of the main body or frame 5 in parallel with the surfaces of the strip or sheet 1 passing through the descaling equipment. The free end of the piston of a power cylinder 16 mounted on the main frame 5 is connected to the movable frame 8 so that the latter may be moved transversely of the surfaces of the strip or sheet 1 as will be described in detail hereinafter.

The movable frame or nozzle carriage 8 carries four sets of descaling spraying devices which are substantially similar in construction so that it will suffice to describe only one of them. Each descaling slurry spraying device consists of a parallel crank four-bar linkage and a plurality of descaling slurry spraying nozzle blocks 2*a* (2*b*). The parallel crank four-bar linkage consists of the supporting column 9, a pair of cranks or arms 13 and a connecting rod or lever 10*a* (10*b*). One or lower ends of the cranks or arms 13 are pivoted with pins 12 to brackets 25 mounted on the top and bottom tie beams of the movable frame 8 while the other or upper ends thereof are pivoted with pins 12 to the connecting rod or lever 10*a* (10*b*) so that the cranks or arms 13 may be in parallel with each other. The lower end of the connecting rod or lever 10*a* (10*b*) is extended downward beyond the cranks or arms 13 and is guided by a guide 15 mounted on the bottom tie beam of the movable frame or nozzle carriage 8. In order to move this linkage, there are provided two power cylinders 14 having their bases pivoted to the supporting column 9 and their pistons pivoted to the cranks or arms 13 intermediate their ends. Thus as the pistons of the power cylinders 14 are extended or retracted, the connecting rod or lever 10*a* (10*b*) is lowered or lifted.

Each nozzle block 2*a* (2*b*) consists of an array of nozzles 2 (to be referred to as "the nozzle assembly" in this specification) and arms 24*a*. The latter are extended from both ends of the nozzle assembly and are pivoted with pins 11 to the connecting rod or lever 10*a* (10*b*) and to the supporting column 9 in such a way that the nozzle assembly may be inclined at an angle $\alpha$ ralative to the supporting column 9 as best shown in FIG. 6.

It is to be emphasized that the length of the supporting arms 24*a* is equal to the distance X between the nozzle orifice and the spray point on the strip or sheet 1 relative to the direction of the passage of the strip or sheet and that the axis or center of the pin 11 on the supporting column 9 is in alignment with the spray point on the strip or sheet 1 of the nozzle 2 most adjacent to said pin 11 on the supporting column 9.

Thus it is apparent that as the power cylinders 14 are extended or retracted so that the connecting rod or lever 10*a* (10*b*) is lowered or lifted, the angle $\alpha$ of inclination of each nozzle block 2*a* (2*b*) with respect to the direction of the passage of the strip or sheet 1 may be increased or decreased. Furthermore, as the power cylinder 16 is extended or retracted, the movable frame or nozzle carriage 8 is displaced transversely as described above, so that the positions of the nozzle blocks 2*a* (2*b*) relative to the surfaces of the strip or sheet 1 may be varied.

In FIG. 6, A and A' are lines connecting the spray points on the strip or sheet 1 of the nozzles 2.

Next referring to FIG. 8, descaling slurry is supplied from a cyclone 17 through an agitator 18 and slurry supply pipes 19 to the nozzles 2 of each nozzle block 2*a* (2*b*). In order to trap the sprayed slurries, there are provided descaling slurry trapping devices or guides 20 which are extended vertically and provided with buffer rubbers 21 in order to absorb the energies of trapped descaling slurries.

With the descaling equipment with the above described construction, the angle $\alpha$ of inclination of the nozzle blocks 2*a* and 2*b* may be optimumly varied in the manner described above so that the overlappingly sprayed portions 4 [See FIG. 3(B)] or more particularly their width W may be varied optimumly depending upon the width of the strip or sheet 1 and physical conditions of scales on it. Thus uniform and satisfactory descaling may be ensured.

After having been sprayed over or impinged against the surfaces of the strip or sheet 1, descaling slurries flow outwardly transversely of the strip or sheet 1 by their own energies so that the descaling slurries sprayed by the upper or upstream nozzle blocks 2*a* and 2*b* will not interfere with the descaling actions of the slurries sprayed by the lower or downstream nozzle blocks 2*a* and 2*b*. As a result, the spacing between the upstream and downstream nozzle blocks 2*a* and 2*b* may be reduced. Since the descaling slurries sprayed by the downstream nozzle blocks 2*a* and 2*b* also flow outwardly transversely of the strip or sheet 1, the quantity of descaling slurries entrained by the lower guide roll 22 may be minimized. When the strip or sheet 1 moves in a zig-zag direction or weaves as it passes through the descaling equipment, the movable frame or nozzle carriage 8 may be transversely reciprocated by the power piston 16 in the manner described elsewhere so that uniform and satisfactory descaling may be ensured.

Next some examples of the present invention will be described. A strip of steel 1.2 mm in thickness and 300 mm in width was made to pass the descaling equipment of the type described above at a velocity of 60 m/min. Each nozzle block consists of 7 nozzles spaced apart from each other by 40 mm. Descaling slurry consisting of 70% by volume of sand iron and 30% by volume of water was sprayed through the nozzle blocks under a pressure of 100 kg/cm$^3$ at a rate of 25 l/min under the conditions that the distance (l) between the nozzle orifices and the surface of the strip was 450 mm and the spray angle $\beta$ (See FIG. 4) was 45°. The spray direction angle ($90° - \alpha$) (See FIG. 3(A)) was varied by actuating the power cylinders 14 with the other conditions remained unchanged. The results are shown in Table I.

TABLE I

| | spray direction angle ($90°-\alpha$) | descaling effects |
|---|---|---|
| The Invention | 25° | some scales remained. |
| | 30° | all scales removed. |
| | 45° | " |
| | 60° | " |
| | 70° | " |
| | 80° | " |
| | | (descaling areas were small) |
| Prior Art | 180° | many scales remained. |

So far the present invention has been described as having two sets of nozzle blocks 2*a* and 2*b* on each side of the strip or sheet 1, but it is to be understood that only one set may be disposed on each side. In the latter case, the spray point on the strip or sheet 1 of the nozzle 2 substantially in the middle of the nozzle block is aligned with the axis of the pin 11 on the supporting column 9.

In summary, according to the present invention, the spray direction angle ($90° - \alpha$) is inclined relative to the direction of the strip or sheet passing through the descaling equipment so that the interference between descaling slurries sprayed by the adjacent nozzles may be avoided. As a result, uniform and satisfactory descaling without vertical tracking may be ensured. In other words, the complex arrangement of the nozzle blocks or assembles as shown in FIG. 2 may be eliminated.

It is to be understood that the present invention is not limited to the preferred embodiment described above and that various modifications may be effected as needs demand. For instance, a plurality of nozzles may be arranged in a zig-zag manner as far as their spray direction angle is inclined to the direction of the passage of the strip or sheet. The spray direction angle may be varied by any other suitable means than that described above. The angular position of the nozzles and their spray direction angle may be varied simultaneously according to a predetermined relationship or independently of each other.

What is claimed is:

1. In apparatus for applying a descaling slurry to a surface of an elongated strip of metal while the strip is moving in the direction of its length, the improvement comprising (a) an elongated linear supporting means positioned in spaced relation to one surface of the strip and extending transversely of the strip at an acute angle to a line which is perpendicular to the length of the strip in the same plane as the strip, (b) a plurality of nozzles positioned in equally spaced relation along the length of the supporting means forming a nozzle array connected to a source of slurry, (c) all of the nozzles being parallel and directed toward said one surface of the strip at an acute spray angle to said one surface of the strip in the direction of movement of the strip, (d) the spacing of the nozzles with respect to each other and to the strip and the configuration of individual nozzles being such that individual streams of slurry emanating from the nozzles do not intersect, individual slurry streams produced by adjacent nozzles strike the strip in a line at the same acute angle as the supporting means, and a lateral part of each slurry stream impinges on an area of the strip previously impinged on by an adjacent upstream slurry stream with a time lag dependent on the speed of movement of the strip.

2. Apparatus according to claim 1, in which the array extends across the entire width of the strip.

3. Apparatus according to claim 1, comprising a plurality of arrays which in combination extend across the entire width of the strip.

4. Apparatus according to claim 1, comprising in addition means for adjusting the acute angle of the supporting means with respect to the line perpendicular to the length of the strip.

5. Apparatus according to claim 4, in which the means for adjusting the acute angle of the supporting means comprises (a) a column extending parallel to and adjacent the strip and fixed with respect to the strip, (b) a connecting rod extending parallel to and adjacent the column and being movable in the direction of the length of the strip, (c) the supporting means being connected at its one end to the column and at its other end to the connecting rod, and (d) means for moving the connecting rod in the direction of the length of the strip and with respect to the column.

6. Apparatus according to claim 5, comprising in addition means for moving the column, connecting rod, nozzle array and moving means transversely of the strip.

* * * * *

UNITED STATES PATENT AND TRADEMARK OFFICE

CERTIFICATE OF CORRECTION

PATENT NO. : 4,251,956

DATED : February 24, 1981

INVENTOR(S) : Hiromasa Hirata, Toyohiko Kirisawa, Takao Kawanami, Michio Sato, and Yasuhiro Omura It is certified that error appears in the above-identified patent and that said Letters Patent are hereby corrected as shown below:

On the title page insert:

-- Assignees: Ishikawajima-Harima Jukogyo Kabushiki Kaisha and Nippon Steel Corporation, Tokyo, Japan --

Signed and Sealed this

*Eighteenth* Day of *August 1981*

[SEAL]

*Attest:*

GERALD J. MOSSINGHOFF

*Attesting Officer*

*Commissioner of Patents and Trademarks*